United States Patent [19]

Nigrelli

[11] 4,215,525

[45] Aug. 5, 1980

[54] TRAY FORMING MACHINE

[75] Inventor: Biagio J. Nigrelli, Kiel, Wis.

[73] Assignee: Johns-Nigrelli-Johns, Sheboygan Falls, Wis.

[21] Appl. No.: 906,497

[22] Filed: May 16, 1978

[51] Int. Cl.[2] ..... B65B 11/08

[52] U.S. Cl. ..... 53/580; 53/207; 53/209

[58] Field of Search ..... 53/579, 580, 207, 209, 53/218, 48, 378, 491; 93/44, 49 R

[56] References Cited

U.S. PATENT DOCUMENTS

| | | | |
|---|---|---|---|
| 656,826 | 8/1900 | Peters | 53/207 |
| 2,066,449 | 1/1937 | Barrett | 53/218 |
| 2,847,810 | 8/1958 | Davey et al. | 53/590 |
| 2,953,070 | 9/1960 | Dunning | 53/48 X |
| 3,015,923 | 1/1962 | Dotzenroth | 53/48 X |
| 3,492,923 | 2/1970 | Stenberg | 53/209 X |
| 3,555,776 | 1/1971 | Nigrelli et al. | 53/580 |
| 3,681,893 | 8/1972 | De Barge | 53/209 |
| 3,869,846 | 3/1975 | Timmerbeil | 53/378 |
| 3,959,950 | 3/1975 | Fukuda | 53/491 |

FOREIGN PATENT DOCUMENTS

| | | | |
|---|---|---|---|
| 1324665 | 7/1973 | United Kingdom | 53/207 |

*Primary Examiner*—John Sipos

*Attorney, Agent, or Firm*—Wheeler, Morsell, House & Fuller

[57] ABSTRACT

Apparatus for forming a tray blank into a tray about its contents. The apparatus includes leading and trailing tray flap folders and side flap folders. The flaps on the tray blank have end tabs which are interconnected in angled oblique relation when the tray blank is formed into a tray, thus to create beveled or oblique corners of the tray. The leading and trailing tray flap folders have oblique fingers which engage the end tabs on the leading and trailing tray flaps to fold the end tabs into oblique position when the flaps are folded. The end tabs on the side flaps of the tray blank have notches into which the fingers are received. A conveyor moves the tray and its contents through the various folding elements.

2 Claims, 10 Drawing Figures

TRAY FORMING MACHINE

BACKGROUND OF THE INVENTION

My U.S. Pat. No. 3,555,776 granted Jan. 19, 1971, shows apparatus for forming a tray around its contents. In this prior patent, the tray has corners which meet at a 90° angle. Where the tray contents do not have 90° angled corners, for example, beverage bottles or cans which are rounded, it is desirable that the tray corners be beveled or disposed at an oblique angle, thus to more snugly embrace tray contents.

SUMMARY OF THE INVENTION

In accordance with the present invention, apparatus is provided to form tray blanks into a tray about tray contents in which end tabs on the tray blank flap are folded to constitute beveled or oblique corners of the tray. Accordingly, tray contents not having 90° angled corners can more snugly be confined or embraced by the tray sides. In accordance with the present invention, leading and trailing tray flap folders are provided with oblique fingers which engage end tabs on the leading and trailing tray flaps so that the end tabs are folded at an oblique angle to the flaps when the flaps are erected. In the disclosed embodiment, the oblique angle is 45°, although other angles appropriate for the specific contents of the tray can be utilized. Folding means are also provided for the side flaps of the tray blanks so as to bend end tabs on the side flaps into a complementary oblique relationship and to engage the bent end tabs on the forward and trailing flaps on the tray blank. The end tabs on the side flaps are provided with notches into which the oblique fingers on the leading and trailing flap folders are received, thus to avoid interference between such fingers and the tabs. The means for folding the end tabs on the side flaps are also desirably provided with notches to avoid interference with such oblique fingers.

Other objects, features, and advantages of the invention will appear from the disclosure hereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

My prior U.S. Pat. No. 3,555,776 shows the prior art apparatus hereinabove referred to. The disclosure herein will not repeat all of the structure shown in my prior patent and will be limited to the novel mechanism and apparatus for creating the beveled or oblique angled corners of the tray. For other structure, reference is made to my prior patent aforesaid.

Figure 8:
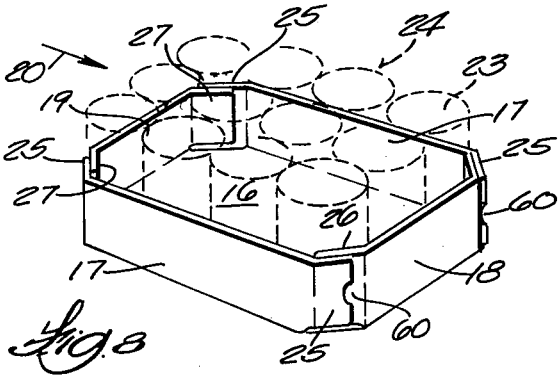
FIG. 8 is a perspective view showing the tray blank with all flaps folded upwardly.

FIG. 8 hereof shows an erected tray formed about a pack 24 of twelve cylindrical beverage containers. This package merely exemplifies articles which can be contained by the tray.

Figure 5:
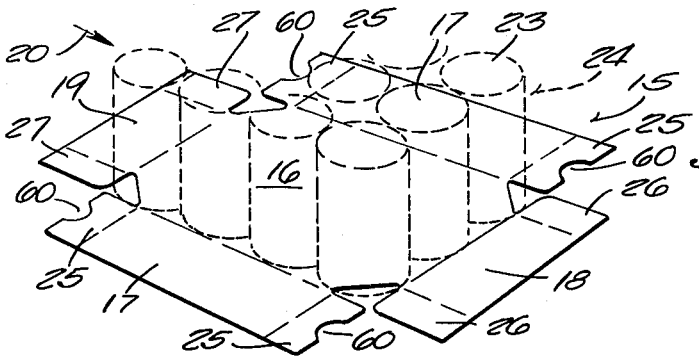
FIG. 5 is a perspective view of a tray blank prior to folding.

As best shown in FIG. 5, the tray blank 15 comprises a cut and scored sheet of tray stock, typically corrugated paperboard having a floor panel 16, side flaps 17, and end flaps 18, 19. When the tray blank 15 is advanced on a conveyor in the direction of arrow 20, end flap 18 is the leading end flap and end flap 19 is the trailing end flap.

The respective flaps 17, 18, 19 are delineated by scorelines about which the flaps may be folded in the course of erecting the tray to its ultimate position shown in FIG. 8.

In order to form oblique corners on the erected tray which will snugly embrace the tray contents such as the cylindrical containers 23 in the cluster or pack of containers 24, the side flaps 18 are provided with end tabs 25, the front flap 18 is provided with end tabs 26, and the rear flap 19 is provided with end tabs 27. The respective end tabs 25, 26, 27 are defined by scorelines about which the end tabs may be hinged or bent away from their respective flaps and into the oblique overlapped relationship shown in FIG. 8 in which the respective end flaps are interconnected in overlapped relationship to form oblique or beveled corners of the tray.

The cluster or pack 24 of bottles or like contents of the tray are grouped together and are deposited on the tray blank bottom 16 in the manner illustrated in my prior U.S. Pat. No. 3,555,776. The leading and trailing flaps 18, 19 and the side flaps 17 are also folded or are erected in a manner similar to that shown in my prior patent, except that the apparatus of this invention is especially adapted to manipulate the end tabs 25, 26, 27 on the various flaps in a special way in order to produce the oblique or beveled corners of the erected tray as hereinbefore described. The apparatus is shown generally in FIGS. 1 and 2, and in more detail in FIGS. 3, 4 and 10, and diagrammatically in FIGS. 7 and 9 of the instant drawing.

Figure 3:
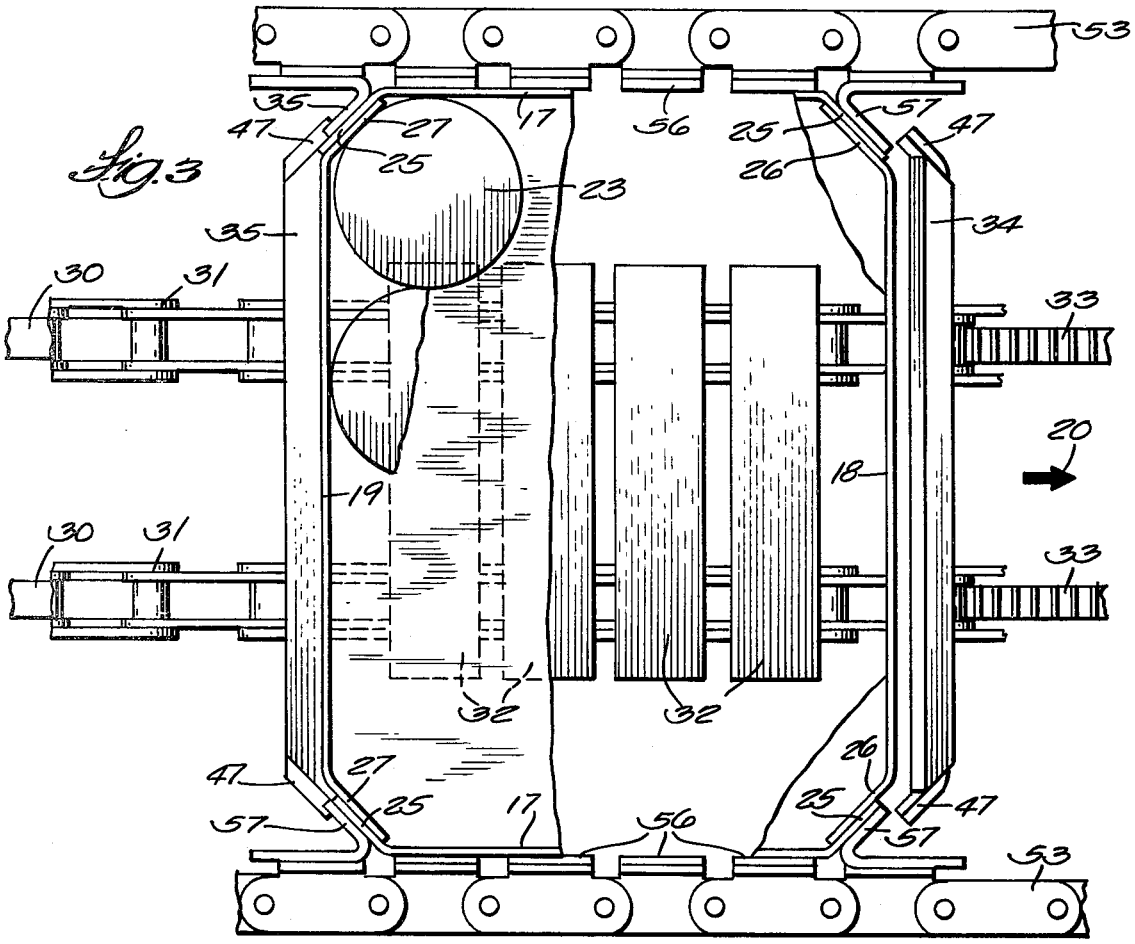
FIG. 3 is a fragmentary enlarged view of a portion of the apparatus shown in FIG. 1.
Figure 10:
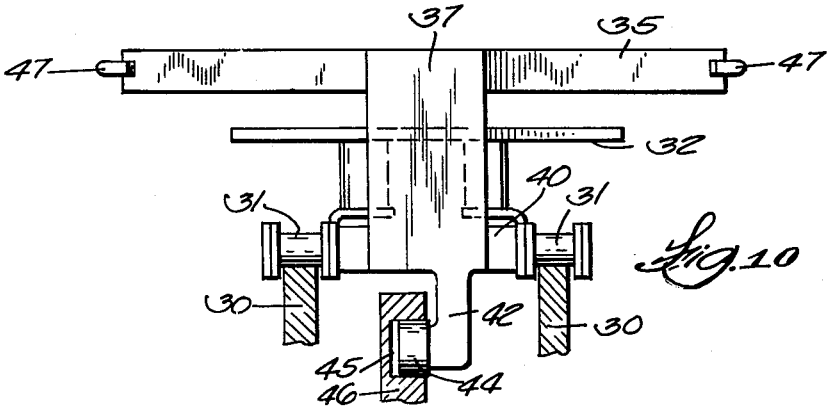
FIG. 10 is a fragmentary cross section taken along the line 10—10 of FIG. 4.

The tray blank 15 and its cluster pack contents 24 are advanced along track 30 by a series of conveyor chains, one of which is shown at 31. Conveyor 31 comprises two parallel chains which are supported on the upper edges of spaced parallel tracks 30 as best shown in FIGS. 3 and 10. Chains 31 carry a platform for the tray and its contents. The platform comprises a series of laterally extending platform segments 32 individually mounted on corresponding links of the chains 31 so that the platform segments 32 can negotiate the curves around the sprockets 33, 48 about which the chains 31 are curved.

Leading and trailing tray flap folders 34, 35 are also carried by the chains 31. The respective folders 34, 35 comprise laterally elongated cross bars mounted on brackets 36, 37 having long swing arms 38, 39 which articulate about common pivot pins 40 connected to the respective chains 31. Each swing arm 38, 39 has a depending cam follower bracket 42 (FIG. 10) with a cam follower roller 44 engaged in a cam track 45. Cam track 45 comprises a slot formed in a cam track plate 46 which extends longitudinally of the machine and between the two tray support tracks 30.

Figure 6:
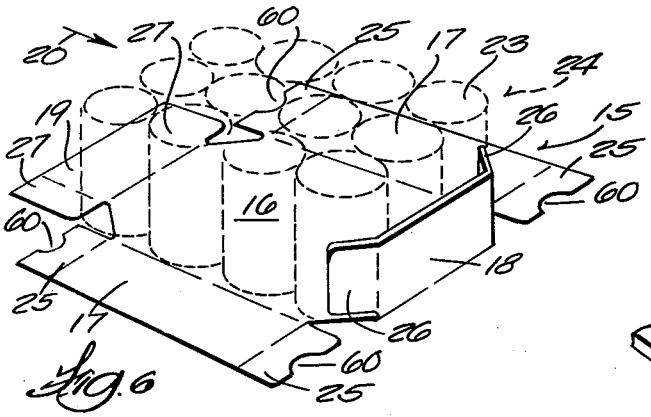
FIG. 6 is a perspective view of a tray blank after its leading flap has been folded upwardly.
Figure 7:
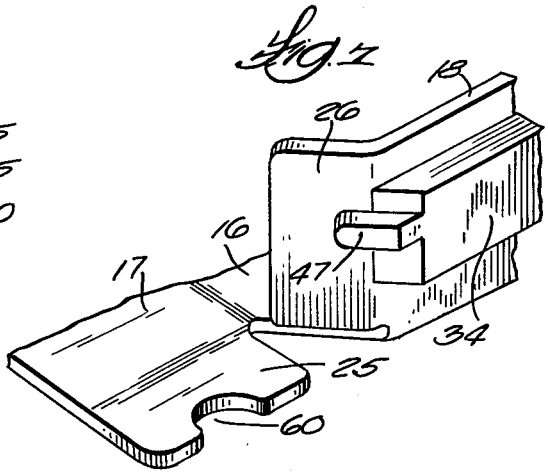
FIG. 7 is a fragmentary perspective view diagrammatically illustrating how the front flap folding bar has folded the front flap.

The leading and trailing flap folding bars 34, 35 are provided with oblique end fingers 47 (FIGS. 3, 7, 9 and 10) which, in the illustrated embodiment, are disposed at about a 45° angle to the direction of travel of the tray blank. Accordingly, as the chains 31 which drive the leading and trailing folders 34, 35 on their path come around their rear sprockets 48 (FIG. 2), the brackets 36, 37 will tilt about the axis of pivot pin 40 because of the configuration of cam track 45. Accordingly, the leading flap 18 and the trailing flap 19 of the tray blank will be sequentially folded or erected against tray contents. Concurrently, the oblique fingers 47 will engage the end tabs 26, 27 on the respective flaps 18, 19 to bend these flaps 26, 27 obliquely as illustrated in FIG. 7 and into the position thereof shown in FIGS. 6 and 8 of the drawing.

Figure 1:
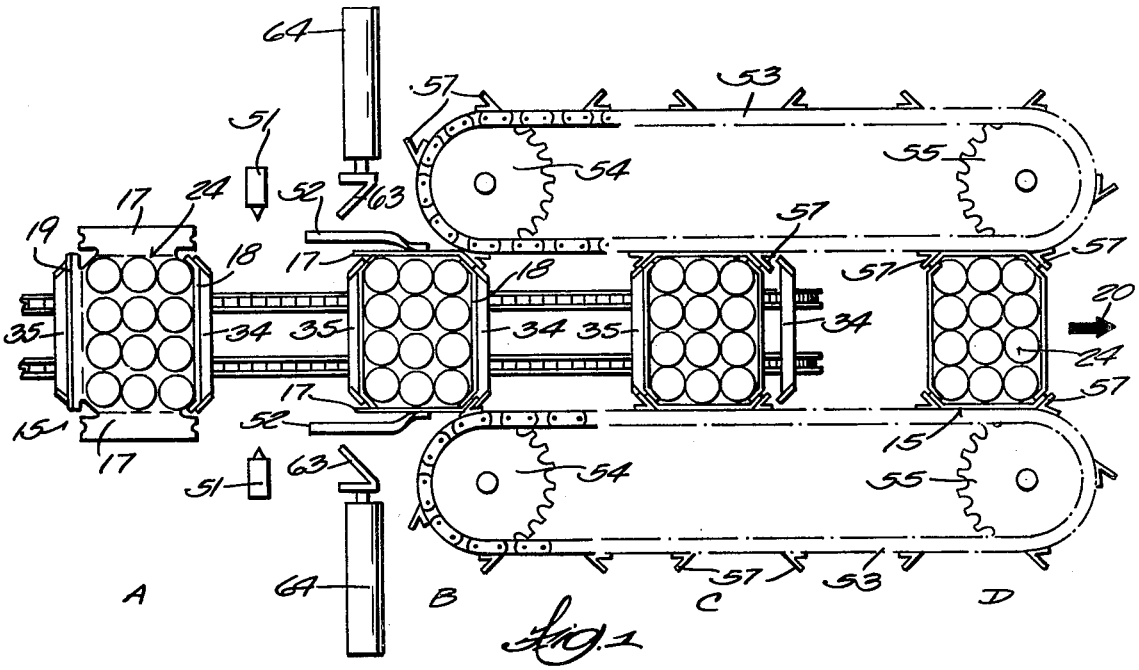
FIG. 1 is a plan view diagrammatically illustrating apparatus embodying the invention.
Figure 2:
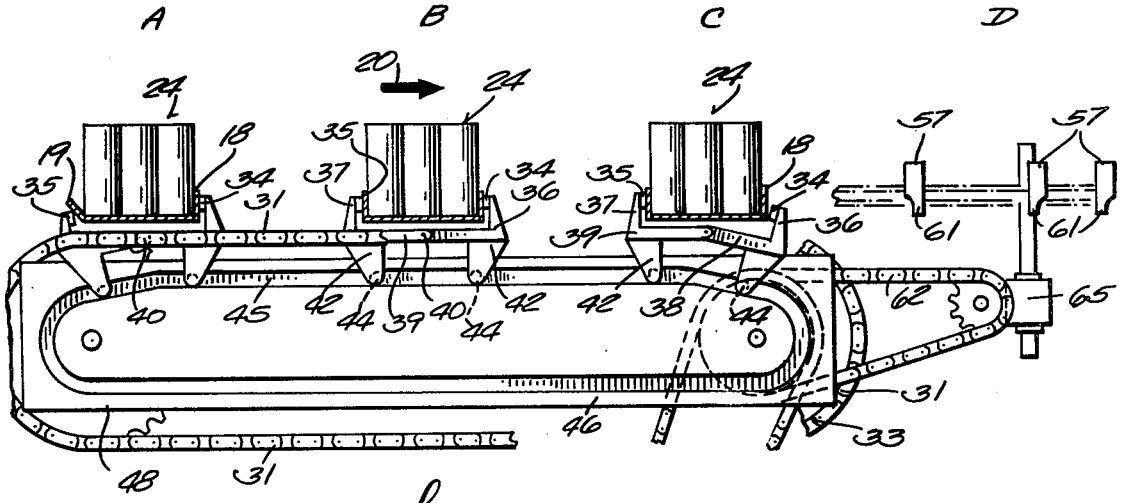
FIG. 2 is a side view of the apparatus of FIG. 1.

At position A of FIGS. 1 and 2, the leading flap 18 has been fully erected and the trailing flap 19 is partially erected in the course of advance of the conveyor in the direction of arrow 20.

The partially erected tray will now pass glue nozzles 51 which will jet glue spots onto the outer surfaces of the erected end tabs 26, 27. Typically, a hot-melt adhesive is utilized in the glue nozzles 51.

As conveyor chains 31 continue to advance the partially erected tray, the side flaps 17 thereof will engage with the plows 52 (FIG. 1) which will lift the side flaps 17 of the tray blank into the upright position shown at position B of FIG. 1.

As the tray and its contents continue to advance in the direction of arrow 20 from position B toward position C, the tray and its contents pass between side chains 53 traveling around sprockets 54, 55. Chains 53 carry segmented side plates 56 and tab folder clips 57. Side plates 56 embrace the upright side flaps 17 of the tray blank to hold these in position against the sides of the package 24. The tab folder clips 57 are arranged in pairs of oppositely inclined oblique pressing clips or fingers which are positioned to engage the end tabs 25 of the side flaps 17 to bend these tabs to the oblique position shown in FIGS. 8 and 9 and press them against the glued surfaces of the oblique tabs 26, 27 on the leading and trailing flaps 18, 19 of the tray blank.

Figure 9:
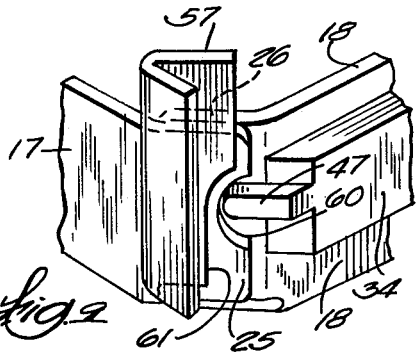
FIG. 9 is a diagrammatic perspective view showing the inter-relationship between the front flap folding bar and the folder for the end tabs of the side flap to create the beveled corner of the tray in which the end tabs interconnect at an oblique angle.

End tabs 25 of side flaps 17 are provided with edge notches 60 so that when the end tabs 25 are bent into their oblique positions shown in FIGS. 8 and 9, there will be no interference between the tabs 25 and the oblique fingers 47 on the tray flap folders 35, 34. The notches 60 receive the fingers 47 therewithin, as illustrated in FIG. 9.

Figure 4:
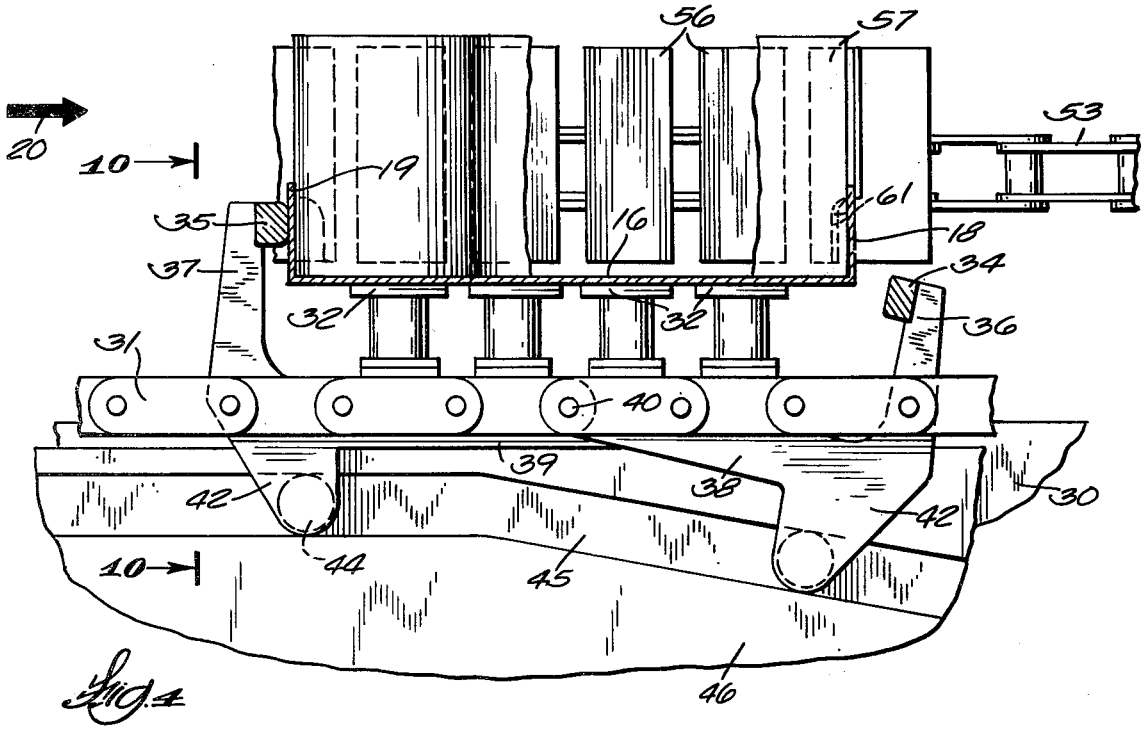
FIG. 4 is a side view of the apparatus shown in FIG. 3.

For the same purpose, the clips 57 on the chains 53 are provided with notches 61 as shown in FIGS. 2, 4 and 9, to avoid interference with the oblique fingers 47. In this manner, the clips 57 can press the end tabs 25 of side flaps 17 tightly against the end tabs 26 of the end flaps 18, 19, and the glue therebetween will set to permanently interconnect the tabs in their oblique or beveled corner configuration while the tray and its contents move continuously from position B to position C and then to position D in FIG. 1 of the drawings.

At position C of the drawings, FIGS. 1 and 2, the leading flap former 36 will disengage from the leading flap 18 on the tray as its cam follower 44 is pulled down by the incline in the track 45 as shown at position C. Meanwhile, the conveyor chains 31 will transfer the tray and its package to take-away conveyor chains 62 for advance to position D(FIG. 1) and ultimate discharge from the machine.

At station D of FIG. 1, the side chains 53 with their tab-folding clips 57 will release the tray and package for discharge from the machine in the direction of arrow 20. By this time, the glue has set to hold the oblique corners of the tray permanently together.

In FIG. 1 are illustrated auxiliary tab folders 63 for the rear tabs 25 on the side flaps 17. These are utilized in the event the machine stops with a tray and package in position B. The fluid cylinders 64 are then actuated to advance the tab folders 63 to bend tabs 25 inwardly to their positions shown in FIG. 8, in order to glue these tabs to the tabs 27 on trailing flap 19 and before the glue previously deposited thereon by the glue nozzles 51 has set.

Chains 31, 62, 53 may be driven from a conventional power source (not shown), for example, through a gear box 65.

I claim:

1. Apparatus for forming a tray blank into a tray about its contents, said tray blank having a central rectangular panel, leading and trailing flaps and side flaps, said flaps having foldable end tabs which are interconnected in oblique superimposed relation when the tray blank is formed into a tray with beveled corners, with the end tabs of said side flaps having marginal notches and said apparatus comprising side flap folders, leading and trailing tray flap folders comprising cross bars having at their ends fixed obliquely bent fingers, said cross bars being connected to endless conveying means beneath said blanks, and cam means to move said cross bars upwardly and fold upwardly said leading and trailing end flaps, and wherein said bent fingers engaging and bending obliquely the end tabs on the leading and trailing tray flaps, an adhesive applicator for applying adhesive to said leading and trailing flap end tabs, and side conveyors having folding clips which project into the conveying path and engage the end tabs on the side flaps and fold them against the end tabs on the leading and trailing tray flaps in the course of conveyor advance, with the notches in the side flap end tabs registering and interfitting with said oblique fingers to provide clearance therebetween, and said engaged folding clips moving in concert with the tray for an interval to insure setting of the adhesive to secure the flaps in assembly, and said cam means releasing said cross bars from engagement with the leading flap, with said notches enabling removal of the oblique fingers from the contacting position with the end tabs while the end tabs are held in assembly by said folding clips.

2. Apparatus for forming a tray blank into a tray about its contents in which the tray has leading and trailing flaps and side flaps, with the flaps having foldable end tabs which are connectable in oblique relation, with said side flap end tabs having marginal notches, said apparatus comprising a conveyor having cross bars with obliquely bent fingers, with said cross bars engaging and erecting the leading and trailing flaps and said fingers folding and maintaining contact with said leading and trailing flap end tabs during the course of subsequent folding operations, means for erecting the side flaps, an adhesive applicator for applying adhesive to said folded leading and trailing flap end tabs, and folding clips for folding said side flap end tabs, said clips having notches to enable movement of the folding clips past the oblique fingers of the cross bars without interference during erecting and applying of the side flap end tabs to the leading and trailing flap end tabs, with said end tab notches interfitting with said oblique fingers, means for supporting and moving said folding clips along with the tray and said end tab notches further enabling removal of the oblique fingers from the contacting position with the end tabs of the leading and trailing flaps while the folding clips maintain the adhesive bond of the end tabs prior to release of the folding clips.

* * * * *